United States Patent [19]

Wahl et al.

[11] 4,040,394

[45] Aug. 9, 1977

[54] APPARATUS REPETITIVELY CONTROLLING THE COMPOSITION OF EXHAUST EMISSIONS FROM INTERNAL COMBUSTION ENGINES, IN PREDETERMINED INTERVALS

[75] Inventors: Josef Wahl, Stuttgart; Peter Jürgen Schmidt, Schwieberdingen; Richard Zechnall, Stuttgart, all of Germany

[73] Assignee: Robert Bosch GmbH, Stuttgart, Germany

[21] Appl. No.: 597,561

[22] Filed: July 21, 1975

Related U.S. Application Data

[62] Division of Ser. No. 396,477, Sept. 12, 1973, Pat. No. 3,919,983.

[30] Foreign Application Priority Data

Sept. 14, 1972 Germany ..... 2245029

[51] Int. Cl.[2] ..... F02B 3/00

[52] U.S. Cl. ..... 123/32 EA; 123/32 EE; 123/119 EL; 60/285

[58] Field of Search ..... 123/32 EA, 119 R, 119 EL, 123/32 EE; 60/276, 285

[56] References Cited

U.S. PATENT DOCUMENTS

| | | | |
|---|---|---|---|
| 3,659,571 | 5/1972 | Lang | 123/32 EA |
| 3,710,763 | 1/1973 | Bassot et al. | 123/32 EA |
| 3,738,341 | 6/1973 | Loos | 123/32 EA |
| 3,742,920 | 7/1973 | Black | 123/32 EA |
| 3,745,768 | 7/1973 | Zechnall et al. | 123/32 EA |
| 3,782,347 | 1/1974 | Schmidt et al. | 123/32 EA |
| 3,919,938 | 11/1975 | Wahl et al. | 60/276 |

*Primary Examiner*—Carroll B. Dority, Jr.
*Assistant Examiner*—Paul Devinsky
*Attorney, Agent, or Firm*—Flynn & Frishauf

[57] ABSTRACT

Certain intervals are determined in which output signals from an exhaust gas sensing device are sensed, and then applied to a control circuit, to control the fuel supply system (carburetor, or fuel injection system) in such a direction that a predetermined ratio of fuel and air is being supplied to the engine to provide exhaust gases of predetermined composition. The intervals are determined by a logic circuit which has applied thereto engine operating parameters such as operating time of the engine after having been started, engine speed, engine power condition (idling, or supplying power), engine temperature, or the like.

17 Claims, 6 Drawing Figures

APPARATUS REPETITIVELY CONTROLLING THE COMPOSITION OF EXHAUST EMISSIONS FROM INTERNAL COMBUSTION ENGINES, IN PREDETERMINED INTERVALS

This is a division, of application Ser. No. 396,477 now U.S. Pat. No. 3,919,983, filed Sept. 12, 1973.

CROSS REFERENCE TO RELATED PATENT AND APPLICATIONS

U.S. Pat. No. 3,483,851, Reichardt, Dec. 16, 1969
U.S. Pat. No. 3,745,768, Zechnall et al, July 17, 1973
U.S. Ser. No. 259,157, filed June 2, 1972, Schmidt et al.
U.S. Ser. No. 265,547, filed June 23, 1972, Wahl et al.
U.S. Ser. No. 259,134, filed June 2, 1972, Topp et al.
U.S. Ser. No. 259,254, filed June 2, 1972, Schmidt et al.
U.S. Ser. No. 267,562, filed May 6, 1972, Eichler et al.
U.S. Ser. No. 266,673, filed June 27, 1972, Eichler et al.
U.S. Ser. No. 282,848, filed Aug. 22, 1972, Eichler et al.
U.S. Ser. No. 283,177, filed Aug. 23, 1972, Eichler et al.
U.S. Ser. No. 271,009, filed July 12, 1972, Scholl U.S. Ser. No. 296,601, filed Oct. 11, 1972, Schneider et al.
U.S. Ser. No. 298,108, filed Oct. 16, 1972, Wahl et al.
U.S. Ser. No. 300,047, filed Oct. 24, 1972, Linder et al.
U.S. Ser. No. 316,008, filed Dec. 18, 1972, Friese et al.
U.S. Ser. No. 314,922, filed Dec. 14, 1972, Schmidt et al.
U.S. Ser. No. 314,921, filed Dec. 14, 1972, Brettschneider
U.S. Ser. No. 332,040, filed Feb. 12, 1973, Glockler et al.
U.S. Ser. No. 322,568, filed Jan. 10, 1973, Mayer The present invention relates to an apparatus to decrease the noxious components in the exhaust emission of internal combustion engines, by supervising the exhaust, at preselected intervals, and controlling the mass ratio of air-fuel being applied to the internal combustion engine in dependence on a sensed output signal from a sensing element, sensing the composition of the exhaust gases.

It is customary to adjust the air-fuel mixture being supplied to internal combustion engines upon original manufacture, and then from time to time, and various devices are provided in order to supply the air-fuel mixture to the internal combustion engines. These may be, for example, carburetors or fuel injection systems. As the vehicle operates, various outside conditions influence the operation and the relative proportion of air and fuel being supplied to the internal combustion engine by the respective mixing device may change. For example, the one or the other component may be subject to drift; the internal combustion engine, itself, is subject to changes during its operation, as a result of the operating time and conditions thereof. All these changes may change the composition of the exhaust gases being emitted from the engine, so that these exhaust gases no longer comply with pollution control requirements set by legislative or regulating bodies. The adjustment of the fuel-air mixture supplying device, the carburetor, or the fuel injection system, may be checked when the engine is being serviced, or tuned, and can be changed to meet requirements; the interval between service checks on the engines becomes longer and longer, however, and thus the time during which the vehicle may operate with an improperly adjusted fuel supply system may be relatively long.

It is an object of the present invention to provide an apparatus which carries out the method to monitor the composition of the exhaust gases in intervals which are shorter than those of the normal service intervals and, if necessary, to change the ratio of fuel and air being supplied, so that the exhaust emission from the engine will comply with legal requirements.

In the apparatus according to the present invention, it is assumed that the mass ratio of air to fuel (expressed as the air number $\lambda$) is set for approximately stoichiometric value, which is to be maintained by the fuel supply system. If the supply system is set for a value of $\lambda = 1$, corresponding to an air-to-fuel ratio of approximately 14.4:1, then the exhaust emissions may be controlled to be a minimum. Such a setting is provided for the engines, usually, when they are new.

In the system according to the present invention, the exhaust gas is analyzed by measuring partial oxidation pressure. In accordance with a further object of the present invention, the system should be simple and, itself, not require servicing except possibly in very extended intervals, and operate reliably and accurately even under the rough conditions of random operation of motor vehicles.

SUBJECT MATTER OF THE PRESENT INVENTION

Briefly, certain intervals are determined in which the output signal from an exhaust gas sensing device is sensed, and applied to a control circuit which controls the fuel supply system (carburetor, or fuel injection system), in such a direction that a predetermined composition of exhaust gases is maintained. The intervals themselves are determined by a logic circuit which has applied thereto at least one of these engine operating parameters: the operating time of the engine, after having once been started, engine speed; whether the engine operates under idling, or power supplying condition; engine temperature. In accordance with a preferred embodiment, each time that the engine is started, a new interval begins, and, upon logical conjunction of two or more of the foregoing parameters, an output signal is provided which effects a connection of the sensing element in the exhaust gas system of the engine, to provide a control signal if the sensing system senses a deviation from a predetermined value, the control signal operating a servo system which tends to re-establish the desired exhaust composition.

In accordance with a feature of the invention, the apparatus includes a first timing switch which is connected to a logic circuit to start a timing interval, and a logic circuit being controlled by at least one of the aforementioned operating parameters, the first timing switch is connected over a second logic circuit to a second circuit which controls a gate, which connects the output signals of the exhaust gas sensing element to the system, that is, which controls the gate to be conductive. When the gate becomes conductive, the servo system is activated to tend to reset the fuel-air mixture applied to the input to re-establish proper exhaust emission.

The exhaust emission itself can be measured in various ways, the present invention being particularly directed to two of these.

One system to measure the exhaust emission utilizes a well known and quite sensitive zirconium-dioxide sensor, having platinum contacts. Such sensors have relatively short life if the fuel includes lead. It is thus desirable to expose such a sensor to the exhaust gases only for a short time and when measuring is actually proceeding.

In accordance with a feature of the invention, the exhaust system is formed with a bypass to the exhaust gases, the sensor being located in the bypass, and the bypass itself being connected to the exhaust gases, for example by means of a flap valve, only when measurement of the exhaust gas is to be effected.

A second system to measure the composition of the fuel-air mixture utilizes an exhaust gas measuring device which is substantially immune to lead poisoning, or sensors having a platinum contact arrangement within a protective sleeve. Such contacting may be made, for example, with catalytically active, electron conductive oxides. Sensors of this type have a relatively long response time, however, that is, the output signal change only after a certain operating condition has persisted for a predetermined period of time. It is therefore necessary that the apparatus provide a constant operating condition for a predetermined time period, for example idling conditions. Such sensors, which are insensitive to lead contamination, but have a slow response time may be left exposed to the exhaust gases at all times, since the contact system is immune to lead contamination or a protective sleeve is provided.

The invention will be described by way of example with reference to the accompanying drawings, wherein:

FIG. 1 is a general, schematic, block circuit diagram to illustrate the system in accordance with the present invention;

FIG. 1*a* is a fragmentary portion of the system of FIG. 1, and illustrating a modification;

FIG. 1*b* is a highly schematic diagram illustrating the use of a lead sensitive sensor, in an exhaust bypass;

Figure 1:
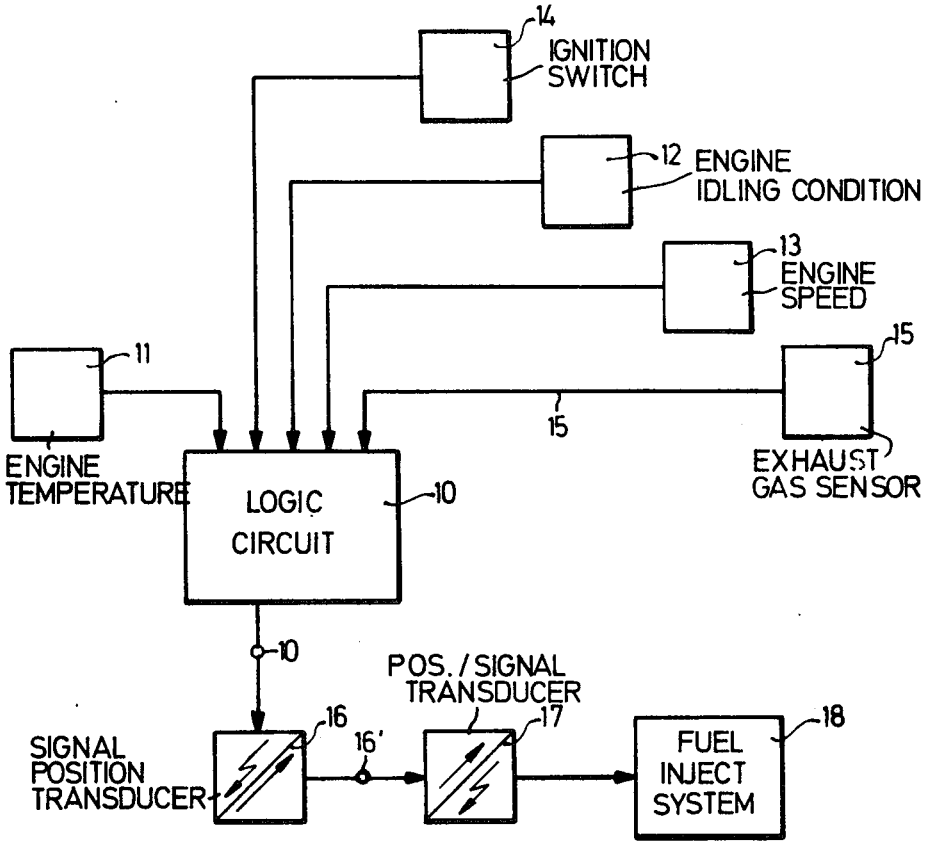
Figure 1A:
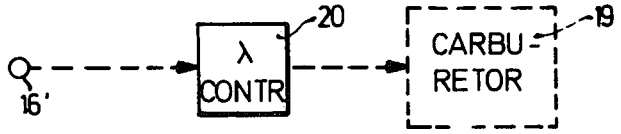

An electrical logic circuit 10 (FIG. 1) is connected to a plurality of sensors, providing output signals representative of operating, or operation parameters of the internal combustion engine, which includes: an engine temperature sensor 11; an idle condition sensor 12, a tachometer generator 13, providing a speed signal, ignition switch 14, and exhaust gas sensors 15. The transducers 11, 12, 13, 14 and 15 provide electrical signals which are connected to the logic circuit 10. The logic circuit 10 provides, at output terminal 10', an electrical signal which is applied to a signal-position transducer 16, which converts the output signal from logic circuit 10, at terminal 10', to a physical displacement. The displacement is available as a position change, schematically indicated by junction point 16'. If the fuel-air mixture supplying device is a fuel injection system, then the displacement at junction 16 is applied, for example, as a displacement of a potentiometer 17, which controls a control parameter in the fuel injection system 18, supplying fuel, together with air, to the internal combustion engine. The control is so connected, that the duration of injection of fuel counteracts any deviation of sensed exhaust gas emission from a set standard, by changing the duration and opening time of the fuel, with respect to the then existing air flow. If the fuel-air supply system is a carburetor 19 (FIG. 1*a*) then the mechanical displacement available at point 16' is connected to an air-fuel adjustment device in the carburetor, schematically indicated as λ control 20. In actual construction, the λ control 20 may, for example, be a control flap in a bypass, or the like, which can be directly controlled from the displacement available at point 16'. By changing the relative bypassed air to carburetor 19, the relative proportion of air and fuel of the air-fuel mixture provided by the carburetor 19 will be changed, due to the addition of more, or less additional air to the mixture.

Other systems and methods can be used to change the relative composition of air and fuel; for example, it is possible to change the fuel supply independently of air supply in the carburetor, by turning a needle valve member supplying fuel, either through the regular carburetor system, the idling jet, or an auxiliary jet; likewise, the passage of air through the carburetor itself can be changed by superimposing a deflection on the carburetor throttle as commanded by the distance output from transducer 16, as schematically indicated at point 16'.

Figure 1B:
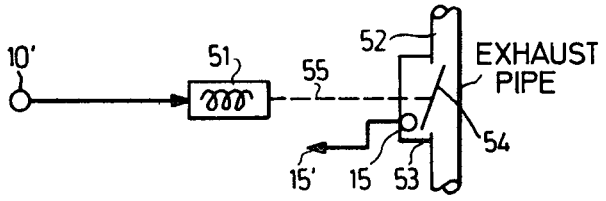

Sensor 15, depending on its construction, may be connected in the exhaust system of the internal combustion engine at all times, or may be exposed to the exhaust gases only temporarily. FIG. 1*b* illustrates a system in which the sensor or transducer 15 is connected only temporarily. The exhaust pipe 52 has a bypass 53 connected therein, which can be selectively closed off by a flap valve 54. Sensor 15 is located in the bypass, and electrically connected by output line 15'. The position of the flap 54 is controlled by a linkage 55 from a magnet 51 which is energized from an output of logic circuit 10, connected to junction 10'. In any case, that is whether the sensor 15 is of the slow acting type permanently exposed to exhaust gases, or of the rapid acting type only temporarily exposed to exhaust gases, logic circuit 10 provides output signals which are utilized to control the relative proportion of air and fuel being supplied to the internal combustion engine either by a fuel injection system 18 or by a carburetor 19, by controlling either the air flow, fuel flow, or fuel injection time, as the case may be.

Figure 2:
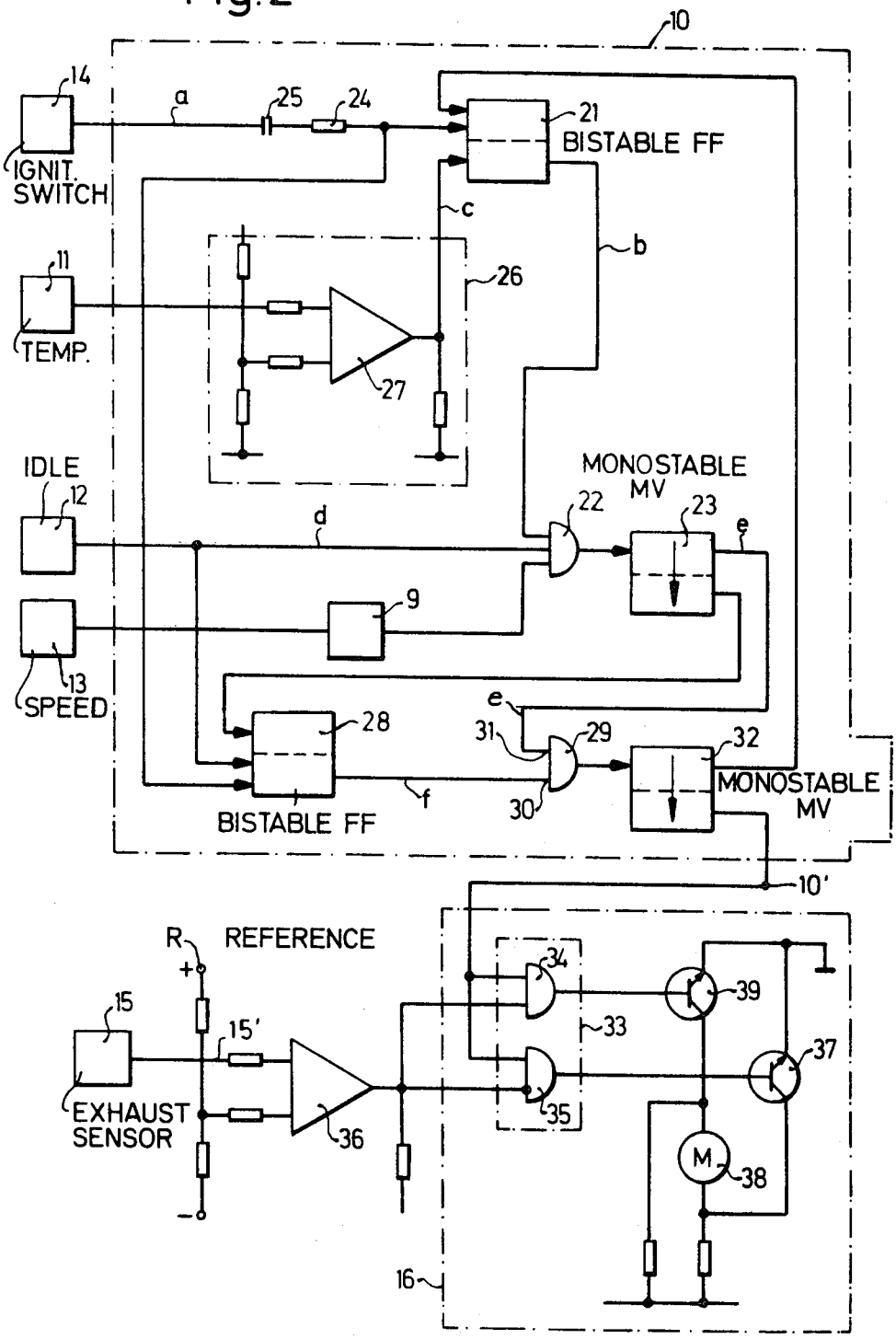
FIG. 2 is a schematic, more detailed diagram illustrating an arrangement to change the fuel-air mixture in a system in which the exhaust sensor is constantly exposed to the exhaust gases.

Referring now to FIG. 2: which shows details of logic circuit a first bistable flip-flop (FF) 21 controls a first timing circuit, over a logic circuit formed as AND gate 22. The timing circuit is a monostable multivibrator (MMV) 23. FF 21 is connected to the ignition switch 14 over a differentiating network formed by a capacitor 25 and resistor 24. Ignition switch 14 is turned ON, when the internal combustion engine (not shown) is started. FF 21 has a second input which is connected to the output of a threshold switch 26, which includes an operational amplifier 27, having one input connected to engine temperature sensor 11.

The second input of the AND gate 22 is connected to an idle sensing switch 12. This switch is closed only when the accelerator control of the engine is not operated, that is, when the engine is idling. When the engine is not idling, switch 12 is open. The third input to the AND gate 22 is connected to a speed sensing switch 9, which has its input connected to a tachometer generator 13. When the speed is at a certain value, an output is derived from switch 9.

The output of the AND gate 22 is connected to the input of MMV 23. The idle switch 12 is further connected to an input of a second FF 28. The output of the second FF 28 is connected to the input terminal 30 of a logic AND gate 29, the first input 31 of which is connected to the first output of MMV 23. The second output of MMV 23 is connected to an input of FF 28. A further input of the FF 28 is connected to the output of the R/C circuit 24, 25 of the differentiator connected to the ignition switch 14. The output of the AND gate is connected to the input of a second timing switch formed as MMV 32. The first output of MMV 32 is connected to an input of the first FF 21; a second output of MMV 32 is connected to the signal/position transducer 16.

The signal/position transducer 16 has an input gate 33 which has two AND gates 34, 35. One input, each, of the AND gates 34, 35 connected to the output of the MMV 32. AND gate 34 is connected directly to the output of an amplifier 36; AND gate 35 is connected to the amplifier 36 over an inverting input. Amplifier 36 is a threshold amplifier and provides a signal when the signal from the exhaust gas sensor 15 reaches a certain value. The output of the AND gate 34 is connected to the control electrode of a transistor 39; the output of the AND gate 35 is connected to the control electrode of a transistor 37. The transistor 37, 39 have their respective emitters grounded; their collectors are connected to a motor 38 which can be connected to a source of potential over one, or the other of the transistors.

Figure 3:
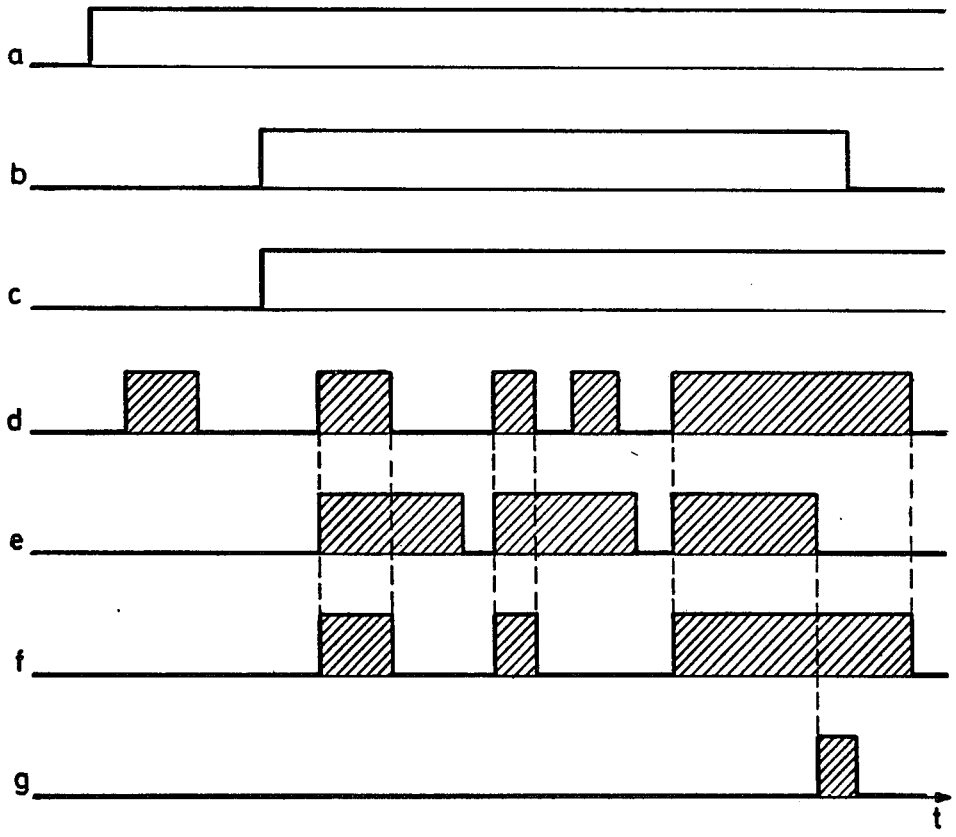
FIG. 3 is a timing diagram, having timing graphs *a* to *g* and showing pulses arising in the system of FIG. 2.

Operation with reference to FIGS. 2 and 3): upon turning the ignition switch 14 ON, the output from switch 14 will be the signal as indicated in line *a* of FIG. 3; the lines which carry the respective signals have been given the same letters in FIG. 2 as the graph letters in FIG. 3. Differentiator 24/25 provides a pulse to one input of the FFs 21, 28 which will change state to be set. When temperature sensor 11 senses a temperature of the internal combustion engine above a predetermined value, threshold switch 26 provides an output signal and FF 21 is reset. The output of the FF 21 is shown in graph *b* of FIG. 3. Since the output from FF 21 is connected as its inverted side, a 1-signal is on line *b* and will be applied to AND gate 22. If idle switch 12 provides an output indicating that the engine is idling, the second input of AND gate 22 will have a 1-signal. If, further, the engine speed is such that the engine is at idling speed, as sensed by tachometer generator 13 and switch 9, a 1-signal will be on the third input of AND gate 22 which provides an output 1-signal to the MMV 23 which will be triggered into unstable state. As MMV changes, the second FF 28 will be set. It will be immediately rest as soon as the idle switch 12 opens. This means that only if the idle switch 12 remains closed during the unstable state of the MMV 23, the second MMV 32 can be triggered into unstable condition over the AND gate 29, that is, upon enabling of terminal 30.

The unstable time of the second MMV 32 is comparatively short. The output signal of sensor 15 will thus be applied over the AND gates 34, 35 to transistors 37, 39, controlling the motor 38 only during this unstable time period, in order to cause motor 38 to operate, for example by changing the tap point of a variable resistor, included in the control portion of an electronic fuel injection system; or to change the angular position of a flap valve in a carburetor fuel supply system. While the second MMV 32 is in its unstable state, transistor 37 commands rotation of motor 38 in one direction, and transistor 39 commands rotation of the motor in the other direction, depending upon the respective output from amplifier 36 which, in turn, will depend upon whether the values applied to the amplifier 36 are above, or below a reference determined by a voltage divider connected to a reference potential R. Output voltage of the sensor is compared over a line 15' with the voltage of the reference. Depending on the relative polarity of the output voltage of the sensor with respect to the reference, either transistor 37 or 39 will be rendered conductive, thus causing operation of the motor in one direction or the other.

The timing diagram makes the operation clear. When the threshold switch 26 responds, its output will be a signal as indicated in graph *c.* Assuming that the engine is idling, switch 12 will provide the output indicated in *d.* Thus, if switch 26 has reset FF 21, if idling conditions pertain, and the proper speed is present, MMV 23 will change into unstable state, as seen in graph *e.* Graph *f* shows the output signal of the second FF 28, in which a 1-signal is provided when the idle switch 12 (graph *d*) is closed and simultaneously the first MMV 23 is in unstable state (graph *e*). The second MMV 32 is operated only when the first FF 28 provides a 1-signal beyond the unstable switching state of the MMV 32 (graph *e*) to provide a short pulse, graph *g,* so that the operating circuit can change the relative ratio of air and fuel being supplied to the internal combustion engine.

The direction of rotation of servo motor 38 of signal-position transducer 16 is determined by the amplifier 36, which is an operational amplifier connected as a threshold switch. The output signal of the sensor 15 is compared with a predetermined reference R; depending on the result, one or the other of the AND gates 34, 35 will be enabled, to control transistors 37, 39, respectively, to be conductive.

Upon switch-over of the MMV 32 into unstable state, the first FF 21 is set into its original state, so that the next time that a change in the relative proportion of air and fuel can be controlled by motor 38 can occur only when switch 14 is again operated, that is, if the other conditions pertain and, further, the engine is again started. The set terminal of the second FF 28 is connected to the first MMV 23, to be set upon return of the first MMV 23 to its original state, unless, of course, either the ignition switch is operated, or the idle signal (graph *d*) from transducer 12 persists.

Figure 4:
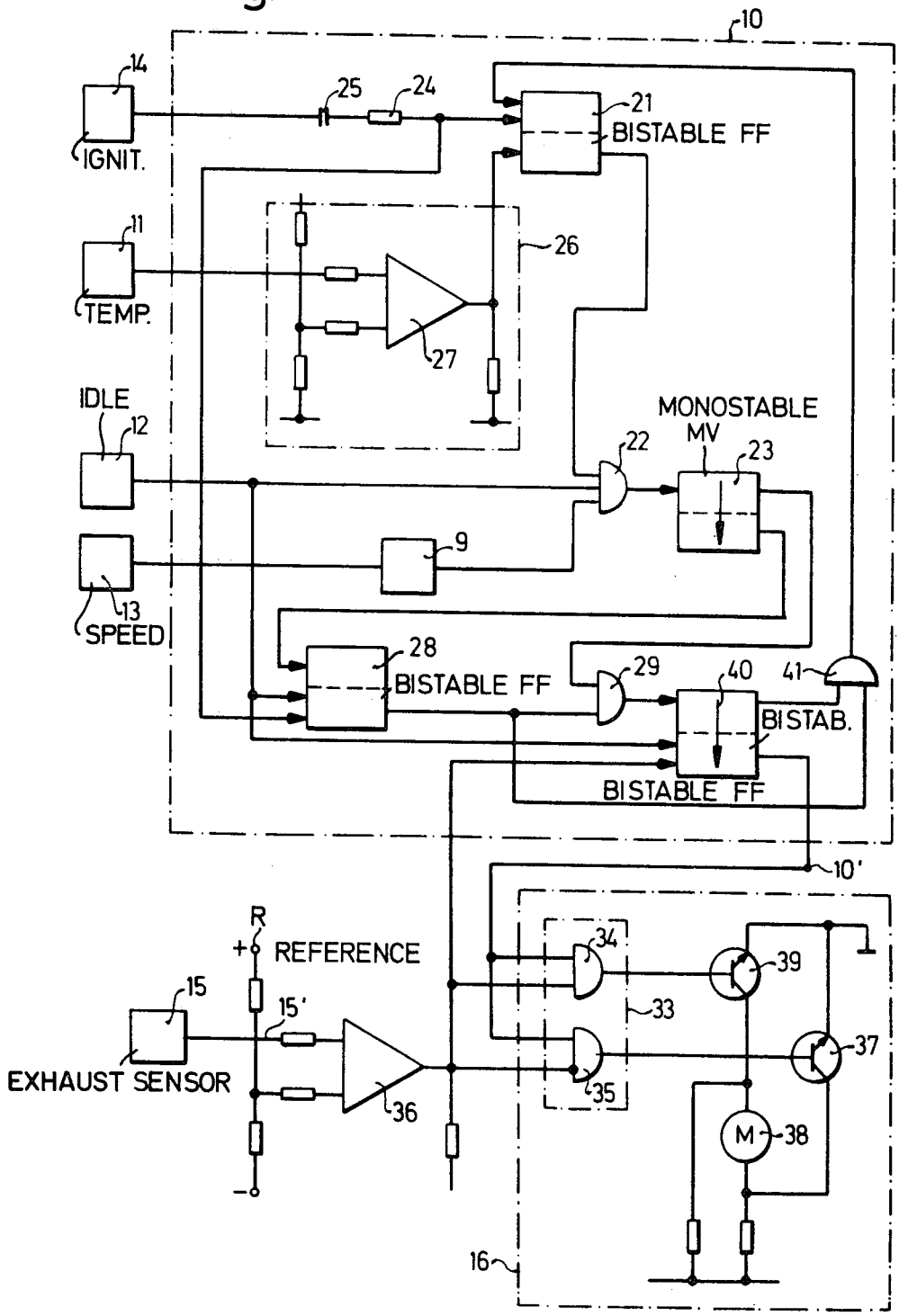
FIG. 4 is a second embodiment of the invention to change the fuel-air mixture by control of the carburetor, or fuel injection system in dependence on composition of the exhaust gases of an automotive internal combustion engine.

FIG. 4 illustrates a modified embodiment, in which similar, or similarly operating parts have been given the same reference numerals and will not be described again in detail. R/C differentiator 24, 25 connects ignition switch 14 to FF 21, and the temperature threshold switch 26 connects the reset terminal of the FF 21. Differing from the circuit of FIG. 2, the output of AND gate 29 is connected to the input of a third FF 40. The FF 40 is further connected to the idle switch 12 and to the output of operational amplifier 36, connected as a threshold switch. One output of FF 40 is connected to a first input of an AND gate 41, the second input of which is connected to the output of the second FF 28. The second output of the FF 40 is connected to the common inputs to the AND gates 34, 35, the other inputs of which are connected to the operation amplifier 36, directly, or over an inverting input, as in the example of FIG. 2.

Operation of circuit of FIG. 4: when switch 14 is connected, the two FFs 21, 28 will be changed to set state. When the temperature has reached a predetermined level, as determined by switch 26, FF 28 will change state to be reset, so that AND gate 22 will have a 1-signal at a first terminal. If idle switch 12 and speed switch 9 also provide 1-signals, MMV 23 is changed to unstable state, which changes over the second FF 28, and over AND gate 29, third FF 40 will be set. When the FF 40 is set, the motor 38 of the signal-position transducer will operate until the output from sensor 15, on line 15', balances the value set by the voltage divider connected between reference source R and has reached its proper value. As soon as operational amplifier 36 changes potential, or if idle switch 12 should open, motor 38 is disconnected since FF 40 will again change state. Resetting of the first FF 21 is obtained over AND gate 41 when the third FF 40 changes stage upon failure of the signal from either operational amplifier 36 or the idle switch 12, provided that the second FF 28 is still maintained in its previous position by the idle switch 12. The response of the switches 28, and 40 may be different.

The adjustment device in accordance with the present invention provides an electronically controlled supervision of exhaust gases, and adjustment of the air-fuel ratio (air number λ) upon the logical conjunction of certain operating conditions. Each time, when the engine is started, the logic circuit is activated, that is, is set to be operated. After the engine has exceeded a certain temperature, for example has reached normal operating temperature, logic circuits provide for sensing of the exhaust gas sensors, for comparison with a reference value. This occurs only, however, if the operating state of the internal combustion engine remained, for a certain period of time, without interruption in idling conditions, and only the first time after the desired operating temperature has been exceeded. The adjustment is provided by changing a suitable element in the air/fuel supply to the engine, driven by a motor 38, for example changing the setting of a potentiometer in the control circuit of the fuel injection system, or the setting of a link, valve, or flap in the air, or fuel supply to the internal combustion engine, or in connection with the carburetor. Depending on the polarity of the deviation of the sensed exhaust signal from the reference, the motor rotates to the right, or to the left, to re-establish balance. The operating period of the motor, itself, is limited. Thus, adjustment will be slow and the first time that a deviation is sensed, the adjustment may not entirely compensate for the deviation, since MMV 32 (FIG. 2) may reset before full compensation has been obtained, or because idling condition may no longer pertain (FIG. 4). Yet, limiting the extent of resetting permits gradual and very exact matching to the desired value, without hunting or overshoot.

If the embodiment of FIG. 4 is selected, and idling persists, the motor will operate until balance is obtained, and provided that the operating parameters, logically permitting energization of the motor continue. It is also possible to so connect the logic circuit that the motor will continue to operate until balance is obtained even through the time period during which measurement is initiated has terminated. In both instances, the readjustment may be limited to occur only when the motor changes from cold to warm condition, that is, each time that the motor is started after prolonged shut-down. The readjustment may also be made each time that a plurality of conditions continue to persist, for example motor at operating temperature, a definite operating state of the engine (for example idle), a predetermined speed.

It is not necessary to select idling speed of the internal combustion engine as one of the parameters; other parameters may be used, provided that, in ordinary operation, they persist for a sufficiently long period of time so that oxygen sensors which are subject to delay in response, can reach balance. Such oxygen sensors usually require several seconds for electrical balance with the gases being sensed. Thus, any parameters which remain in this condition for a time sufficient for the sensor to respond may be selected, such as speed, throttle position, pressure (or rather, vacuum) in the intake manifold, air flow, or air/fuel flow to the engine, or any other operating, or operation condition of the engine which can be clearly defined, and which is apt to recur in definite intervals.

The bypass (FIG. 1*b*) in which the sensor 15 is located if, for example, it is subject to contamination by lead, may be operated by a flap, controlled from a solenoid 51 which is connected to terminal 10', the output of the logic circuit. Terminal 10' is shown in FIG. 2 and 4, and provides an output which is independent of the sensor itself. The solenoid 51 can also be connected to be operated when the FF 21 provides a 1-signal on its output line, in order to provide some pre-heating time to the sensor 15 so that heat balance can be achieved before the actual measurement is made, which will control the motor 38 (compare graphs *b* and *g* in FIG. 3), the flap valve 54 being closed as soon as FF 21 is again set. This flap valve will remain closed until the engine is again started, and another measuring cycle can commence.

If the fuel-air supply is provided by a fuel injection system, which is entirely electronic, then the output at terminal 10' need not be applied to a system including a servomotor 38 to control a potentiometer, to change the electronic circuit controlling the fuel injection time, but, rather the output at terminal 10' can be used to electronically control the operating times, for example by connecting transistors 37, 39, selectively, in a shunt circuit to a timing element in the electronic fuel injection circuit, such as capacitor, or the like, to change the discharge, or charge rate of the capacitor, and thus change the timing of the injection duration of fuel by the fuel injection circuit. Such a system, without the motor 38, however, then is the electronic equivalent of a combination of transducers 16, 17, taken together.

Various changes and modifications may be made within the scope of the inventive concept.

We claim:

1. Apparatus to control the composition of exhaust gases from an internal combustion engine subject to operating parameters including engine temperature, engine power, engine speed, and ignition switch operation, said apparatus having an exhaust gas sensor (15), a fuel-air mixture and balance means (17, 18, 19, 20) adjusting the relative proportion of fuel and air supplied to the engine; and means (11, 12, 13, 14) sensing at least one of said operating parameters;

said apparatus comprising a first timing circuit (23) generating and operating time signal having a limited duration with respect to the operating time of the engine after starting of the engine and subsequent to the engine having been stopped;

a first logic circuit (22) connected to at least one of said operating parameters and having its output connected to and controlling said first timing circuit (23) to start a timing interval of said limited time duration upon energization by said logic circuit (22);

a second timing circuit (22, 40);

a second logic circuit (29) connecting the output of said first timing circuit (23) to the second timing circuit (32, 40):

and gating means (33) enabled by the output of said second timing circuit connecting the output signal from the exhaust sensor (15) to said balance means (17, 18, 19, 20).

2. Apparatus according to claim 1 further comprising a first flip-flop (21) connected to the input of the first logic circuit (22); and means connecting the engine speed sensing means (13), the input of said first logic circuit (22).

3. Apparatus according to claim 2 wherein said first flip-flop (21) is connected further to the engine temperature sensing means (11) and the output of the second timing circuit (32, 40).

4. Apparatus according to claim 1 wherein the engine power operating condition sensing means (12) is connected to said first logic circuit (22) and provides a signal thereto indicative if the engine is operating under idling conditions, or under other operating conditions.

5. Apparatus according to claim 1 further comprising a second flip-flop (28) having its input connected to said first timing circuit (23), the engine power condition operating means (12), and the ignition switch sensing means (14):

and wherein the second logic circuit (29) comprises a multi-input gate having its input connected to the output of said first timing circuit (23) and the output of the second flip-flop (28).

6. Apparatus according to claim 1 wherein the gating means (33) comprises two AND gates (34, 35), and said second timing circuit (32) is a monostable multivibrator having its output connected to an input, each, of the AND gates (34, 35), and the sensor (15) is connected to said AND gates for respective selective energization thereof if the sensor indicates a sensed signal which deviates from a predetermined value in positive, or negative direction.

7. Apparatus according to claim 1 wherein the gating means (33) comprises two AND gates (34, 35);

said second timing circuit is a third flip-flop (40) said third flip-flop (40) having its input connected to the second logic circuit (29), and the engine power condition operating sensing means (12) and the output from said sensor (15).

8. Apparatus according to claim 7 wherein said third flip-flop (40) is connected to one input, each, of the AND gates 34, 35;

and the sensor (15) is connected to said AND gates for respective selective energization thereof if the sensor indicates a sensed deviation, in either direction, from a predetermined level.

9. Apparatus according to claim 1 further comprising a second flip-flop (28) having its input connected to the first timing circuit (23), the engine power operation condition sensing means (12) and the ignition switch (14).

10. Apparatus according to claim 9 wherein said second timing circuit is a third flip-flop (40), a first input flip-flop (21) is provided, connected to change state when the means sensing at least one of the parameters responds;

and wherein said apparatus further comprises an AND gate (41) having one input connected to an output from the third flip-flop (40) and another input connected to an output from the second flip-flop (28), the output from said AND gate (41) being connected to the first input flip-flop (21).

11. Apparatus according to claim 1 wherein said gating means comprises a pair of AND gates enabled by the output from said second timing circuit (32, 40);

the sensor (15) is connected to said AND gates, for respective selective energization thereof if the sensor indicates a sensed signal deviation, in either direction, from a predetermined level;

and the balance means comprises transducer means (37, 39; 38) energized by the output from said AND gates (34, 35) to adjust the relative proportion of the air to fuel being supplied to the internal combustion engine in the direction controlled by the direction of deviation from said predetermined level as sensed by the sensor (15) and commensing at the time of enabling of said AND gates by the second timing circuit (32, 40).

12. System to control the composition of exhaust gases from an internal combustion engine subject to operating parameters including engine temperature, engine power, engine speed, ignition switch operation, said system including an exhaust gas sensor (15) providing an exhaust output signal representative of composition of the exhaust gases;

a fuel-air mixing and balancing means (17, 18, 19, 20) adjusting the relative proportion of fuel and air applied to the engine;

means (11, 12, 13, 14) sensing at least one of said operating parameters and providing an indication signal of the respectively sensed parameter when said parameter has reached a predetermined value;

a timing interval timing circuit (32) controlling generation of a time signal having a limited time duration with respect to operating time of the engine after starting of the engine subsequent to the engine having seen stopped and enabled to start said timing interval when the respective sensing means provides said indication signal;

and an operating control means (17, 18, 19, 20) connected to and controlled by the timing interval time circuit (32) and acting on and adjusting the fuel-air mixing and balance means to adjust the relative proportion of fuel and air in dependence on said exhaust output signal and to change, if required, said relative proportion only upon presence of the indication signal and said timing signal.

13. System according to claim 12, wherein the internal combustion engine has an exhaust system (52) including a bypass (53) selectively separable from said exhaust system, the exhaust gas sensor (15) being located in said bypass;

and means (51, 55, 54) selectively isolating the bypass from the exhaust system (52), the isolating means being connected and controlled by said timing interval time circuit (23) to open the bypass and expose the gas sensor (15) to the exhaust gases in the exhaust system only during said limited time duration.

14. System according to claim 13, further comprising conjunctive logic means connected to the sensing means providing the indication signal and to said timing interval timing circuit means generating the time signal and controlling the bypass actuating means to expose said gas sensor (15) to the exhaust gases only upon occurrence of the indication signal and during said timing interval.

15. System according to claim 12, wherein the internal combustion engine has an exhaust system (52), and the exhaust gas sensor (15) is mounted in gas sensing relationship with respect to exhaust gases passing through said system.

16. System according to claim 12, wherein the sensing means comprises an engine temperature sensor (11);

an engine power condition sensor (12);

an engine speed sensor (13);

and an ignition switch operation sensor (14);

and means (24, 25; 21, 22, 23) connected to said ignition switch sensor (14) and to said temperature sensor, said engine power condition sensor (12) and said engine speed sensor (13) and providing an output signal to said operating control means to render said operating control means effective, when the engine temperature sensor (11) senses that the engine has reached a predetermined temperature level; the engine power condition operation sensor (12) senses that the engine is operating under idling conditions; and the engine speed sensor (13) senses that the speed of the engine is within a predetermined range and to insure that these conditions pertain for the first time after the engine has been stopped and has been restarted.

17. System according to claim 25 further comprising an additional timing circuit (23) connected to said engine temperature sensor (11) and said engine power condition operation sensor (12) and determining a further timing interval, said further timing circuit (23) being interposed in the connection of said respective sensors and the operating control means to enable the operating control means only if said sensors sense persistance of conditions of the other predetermined value for a time duration of said further time interval.

* * * * *